United States Patent [19]

Gottschalk

[11] 4,299,017

[45] Nov. 10, 1981

[54] APPARATUS FOR SMOOTH ROLLING THE BEARING SEATS OF CRANKSHAFTS

[75] Inventor: William P. Gottschalk, Mt. Clemens, Mich.

[73] Assignee: W. Hegenscheidt Gesellschaft mbH, Erkelenz, Fed. Rep. of Germany

[21] Appl. No.: 38,219

[22] Filed: May 11, 1979

[51] Int. Cl.[3] ..... B24B 39/00; B24B 39/04

[52] U.S. Cl. ..... 29/90 R; 72/110; 29/6

[58] Field of Search ..... 29/6, 90 R; 72/107, 72/108, 110

[56] References Cited

U.S. PATENT DOCUMENTS

| | | | |
|---|---|---|---|
| 2,075,394 | 3/1937 | Hazelett | 29/90 X |
| 2,247,887 | 7/1941 | Nascimbeni | 29/90 |
| 2,375,108 | 5/1945 | Hopkins | 29/90 X |
| 2,915,809 | 12/1959 | Egger, Jr. | 29/90 X |
| 3,735,620 | 5/1973 | Naumann | 72/108 X |
| 3,818,559 | 6/1974 | Benson | 29/90 |

FOREIGN PATENT DOCUMENTS

| | | | |
|---|---|---|---|
| 635571 | 1/1962 | Canada | 29/90 |
| 1070955 | 12/1959 | Fed. Rep. of Germany | 29/90 |
| 2146994 | 4/1973 | Fed. Rep. of Germany | 72/108 |
| 1167020 | 10/1969 | United Kingdom | 29/90 |

*Primary Examiner*—Lowell A. Larson

*Attorney, Agent, or Firm*—W. G. Fasse; D. F. Gould

[57] ABSTRACT

This rolling apparatus comprises tool rollers for finish or smooth rolling the bearing seats of crankshafts. Each tool roller is supported by two idler rollers along its length. In addition, the tool rollers are supported against axial displacement by glide plates. Each tool roller end is held in a recess of a respective glide plate. The recess narrows down at the roller holding end so that the respective roller can protrude only partially beyond the glide plates but sufficiently against the bearing seat to be smoothed. The glide plates are made of a material, such as brass or the like, which will protect the respective axial guide faces of the crankshaft bearing seat.

4 Claims, 3 Drawing Figures

APPARATUS FOR SMOOTH ROLLING THE BEARING SEATS OF CRANKSHAFTS

BACKGROUND OF THE INVENTION

The invention relates to an apparatus for finish rolling or smoothing crankshaft bearing seats by means of cylindrical rolling tools. The rolling tools are supported on the one hand at the crankshaft bearing seat and on the other hand at each of the circumferential surfaces of two large idler rollers situated side by side. The rolling tools may be provided with contoured radii at the transition zone from the cylindrical surface area to the base surfaces of the rolling tools or tool rollers.

Finish rolling devices of this type are described in U.S. Pat. No. 3,735,620. Such devices have, in addition to cylindrical rolling tools, opposingly arranged frustum cone-shaped rolling tools which bear axially against the surfaces of the transition radii, whereby the entire apparatus is provided with a stable guide. Apparatuses of this type have been proven to be most useful for machining of crankshaft bearing seats with tangential radii transitions because a contacting of the axial guiding surfaces of the crankshaft bearing seats is prevented by the frustum guide rollers.

However, in crankshaft bearing seats in which the radii transitions are not tangential, but rather radially and/or axially grooved by plunge cutting, the disadvantage occurs that the rolling tools may no longer be supported at the surfaces of the radii transitions. Rather, the facing ends of the rolling tools bear against the axial guiding surfaces of the crankshaft bearing seats thereby damaging the bearing seats and thus rendering the work piece being machined totally unusable.

The exclusive use of cylindrically shaped rollers is necessary in order to avoid axial sliding. Such sliding necessarily occurs where frustum cone-shaped rolling tools are used. Such sliding may be desirable when machining crankshaft bearing seats with tangential radii transitions. Otherwise, such axial sliding must be avoided. It appears, however, that the idler rollers and the rolling tools cannot be made absolutely cylindrical, nor can the axes of the rollers be set absolutely parallel to one another due to unavoidable inaccuracies or machining tolerances. Thus, an axial movement of the rolling tools and of the idler rollers may occur in respective opposite directions due to the roll motion of the rolling tools on the work piece. Due to this axial movement the tool housing on the one hand, and the base surface of the cylindrical tool roller on the other hand run against the respective axial guide surfaces of the crankshaft bearing seats whereby the above mentioned damages to the axial guide surfaces of the crankshaft bearing seats are caused.

OBJECTS OF THE INVENTION

In view of the above it is the aim of the invention to achieve the following objects singly or in combination:

to produce a finish rolling or smoothing apparatus for machining crankshaft bearing seats with radially and/or axially grooved transition radii without damaging the axial guide surfaces of the work piece.

to avoid that the base surfaces of the roller tools contact the guide surfaces of the work piece; and to minimize the wear and tear of glide plates that are being used according to the invention between the ends of the roller tools and the guide faces of the work piece.

SUMMARY OF THE INVENTION

According to the invention there are provided stationary slide plates for each axial end of the smoothing roller tools. The slide plates are connected to a housing taking up the smoothing roller tools. The glide or slide plates cover the base surfaces of the roller tools at least to the extent that the sides of the glide plates facing away from the base surfaces may bear against axial guide faces of the crankshaft bearing seats.

The glide plates according to this invention prevent the base surfaces of the roller tools from directly contacting the axial guide faces of the crankshaft bearing seats. The damages described above, which are caused by such direct contact in the prior art are thus avoided.

BRIEF FIGURE DESCRIPTION

In order that the invention may be clearly understood, it will now be described, by way of examples, with reference to the accompanying drawings, wherein.

DETAILED DESCRIPTION OF PREFERRED EXAMPLE EMBODIMENTS AND OF THE BEST MODE OF THE INVENTION

Figure 1:
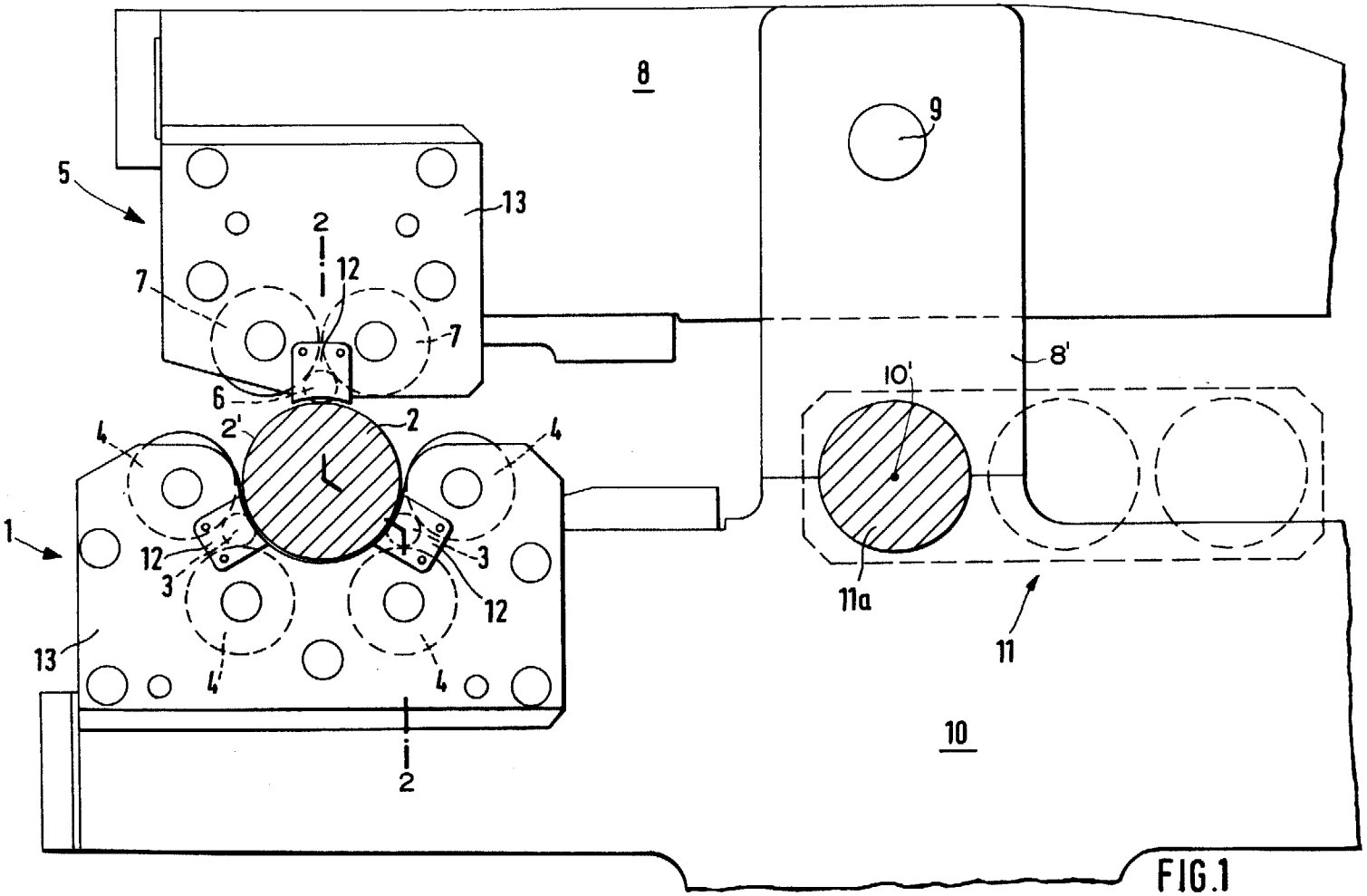
FIG. 1 shows a side view partially in section of a finish rolling or smoothing apparatus according to the invention in which the crankshaft is supported in a centerless manner on its circumference.

FIG. 1 shows a lower tool head 1 and an upper tool head 5. The lower tool head 1 provides for each bearing seat 2' of a crankshaft 2, two rolling or smoothing tool rollers 3 spaced from each other by 120° relative to the axis of the bearing seat 2'. Each of the rolling tools 3 is supported by two idler rollers 4 and rests against the respective bearing seat 2' of the crankshaft 2. This type of supporting a work piece is known as a centerless support.

The upper tool head 5 is arranged opposite the lower tool head 1 and is equipped with a third rolling or smoothing tool roller 6 also displaced 120° relative to the rolling tools 3. The upper rolling tool 6 also rests against the bearing seat 2' of the crankshaft 2 and is supported by two respective idler rollers 7. The idler rollers 7 are supported in a two-armed lever 8, which is connected to a two-armed lever 10 carrying the lower tool head 1. The lever 8 pivots about a bolt 9 with the aid of hydraulic means not shown.

The mounting or bearing support of so-called master shafts 11, only one master shaft 11 is shown in FIG. 1, is connected to the crankshaft 2 to be machined in such a way that the tool head 1 with the rolling tools 3 is provided with a pivot point 10' in the lever 10. This pivot point 10' lies in the crankpin **11*a* of the master shaft 11. The upper tool head 5 with its rolling tool roller 6 acting as a counter roller is held in the lever 8. The lever 8 is supported by upright member 8' relative to the same crankpin of the master shaft 11**. The function and operation as well as structural assembly of the master shaft arrangement are described in detail in U.S. Pat. No. 3,735,620 and in German Pat. No. 2,146,994.

Figure 2:
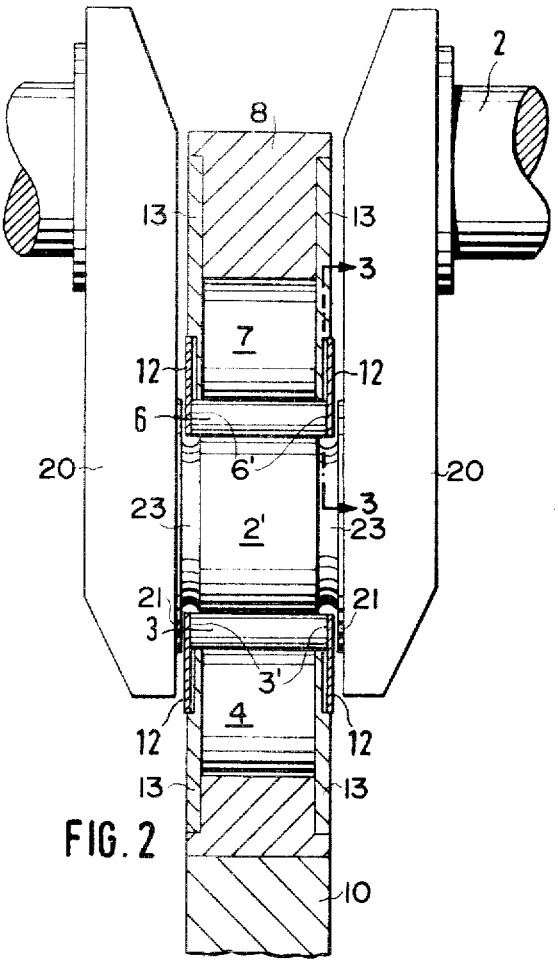
FIG. 2 shows a section along the section line 2—2 in FIG. 1 showing the position of the present glide plates relative to the respective tool roller.

As shown in FIG. 2, glide plates 12 are arranged, according to the invention, adjacent to both base surfaces 3', 6', at each end of the tool rollers 3 and 6. The glide plates 12 are rigidly connected to the housings 13 of the idler rollers 4 and 7. The glide plates 12 extend axially between the base surfaces 3', 6' of the tool rollers 3 and 6 and crank cheeks 20 to such an extent that the axially outwardly facing surfaces of the glide plates 12 cooperate with axial guiding faces 21 of the bearing seats 2' of the crankshaft 2. However, the glide plates 12 do not completely cover the base surfaces 3', 6' of the tool rollers 3 and 6. In other words, the tool rollers 3 and 6 extend partially beyond the edge of the respective glide plates 12, which edge faces the crankshaft 2. Thus, the glide plates 12 do not interfere in any way with the finish rolling operation.

Figure 3:
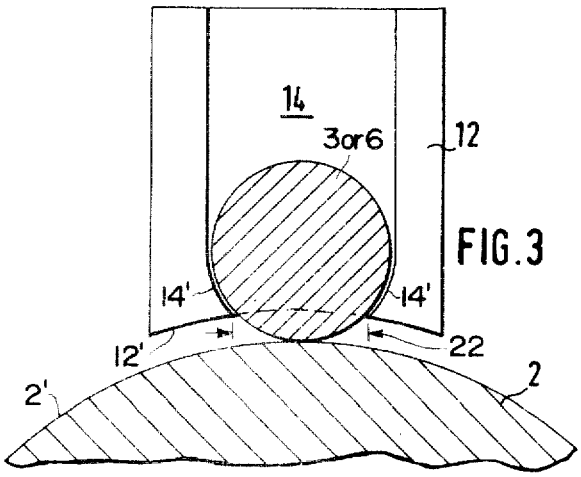
FIG. 3 shows on an enlarged scale, a section along section line 3—3 in FIG. 2.

FIG. 3 illustrates that each glide plate 12 has a recess 14 taking up a respective end portion of the tool rollers 3, 6. The recess 14 is constructed with radially inwardly facing curved shoulders 14' so that, although the tool rollers 3, 6 extend partially outside the contour of the glide plate pair 12, the rollers 3, 6 cannot slide through between the respective pair of glide plates 12. This is so because the width of the recess 14 decreases in the direction of the edge 12' facing the crankshaft 2 since the curved shoulders 14' correspond to the radius curvature of the cylindrical tool rollers 3 and 6. Hence, the recess 14 has an opening width 22 at the edge region 12', which width 22 is smaller than the diameter of the tool rollers 3 and 6.

Incidentally, the tool rollers 3, 6 may be provided with a rounded edge between its own cylinder jacket and the respective end face 3', 6'.

The construction and arrangement of the glide plates 12 according to the invention dependably prevent, that the base surfaces 3',6' of the tool rollers 3, 6 contact the axial guiding faces 21 of the bearing seats 2', especially where the bearing seats 2' proper are spaced from the respective crankshaft cheek 20 by recessed transition zones 23 having a given radius. Thus, the glide plates 12 prevent damage to the guiding faces 21.

Due to the curves 14' in the lower ends of the recesses 14, the tool rollers 3, 6 are properly held by the glide plates 12 yet permitted to protrude toward the work piece surface, namely, the crankshaft bearing seat 2'. Thus, the intended function of the tool rollers 3, 6 is assured. The curved shoulders 14' of the recess 14 have preferably the shape illustrated in FIG. 3 which assures that a cylinder section of the respective tool roller 3,6 properly protrudes toward the work piece as shown in FIG. 3.

Preferably, the glide plates 12 are made of brass or brass alloys or of reinforced hard synthetic materials which assure that the axial guide faces 21 of the bearing seats 2' are optimally protected by the glide plates 12 which bear at least partially against the guide faces 21 while simultaneously keeping the wear and tear of the glide plates 12 small. A suitable hard synthetic material for the present purposes is polyethylene #UHMW.

Although the invention has been described with reference to specific example embodiments, it will be understood, that it is intended to cover all modifications and equivalents within the scope of the appended claims.

What is claimed is:

1. An apparatus for smooth rolling the bearing seats of crankshafts having axial guide faces adjacent each end of each bearing seat, comprising tool roller means (3, 6), support idler roller means (4, 7) centerless and operatively supporting said tool roller means (3, 6), tool support means (13) operatively supporting said support idler roller means (4, 7), glide plate means (12) operatively secured to said tool support means (13) and having axially inwardly facing sides for holding the respective tool roller means (3, 6) at each end thereof, said glide plate means further having axially outwardly facing sides, said glide plate means covering the respective tool roller end to such an extent that said axially facing sides of said glide plate means may bear against the respective guide face (21) of the corresponding crankshaft bearing seat to thereby prevent the tool roller ends from contacting said guide faces (21) to avoid damage to the guide faces (21) by the tool roller means.

2. The apparatus of claim 1, wherein said axially inwardly facing sides of said glide plate means (12) comprise recess means (14) having curved shoulders (14') facing radially inwardly in such a manner that the respective tool roller means project radially outwardly partially from said recess means (14).

3. The apparatus of claim 1 or 2, wherein said glide plate means are made of brass or brass alloys.

4. The apparatus of claim 1 or 2, wherein said glide plate means are made of hard synthetic material.

* * * * *